US006320491B1

(12) United States Patent
Gevorgian et al.

(10) Patent No.: US 6,320,491 B1
(45) Date of Patent: Nov. 20, 2001

(54) BALANCED INDUCTOR

(75) Inventors: Spartak Gevorgian, Göteborg; Bertil Hansson, Agnesberg, both of (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/532,898

(22) Filed: Mar. 22, 2000

(30) Foreign Application Priority Data

Mar. 23, 1999 (SE) ..... 9901060

(51) Int. Cl.[7] ..... H01F 5/00
(52) U.S. Cl. ..... 336/200; 336/83; 336/232
(58) Field of Search ..... 336/200, 223, 336/232, 83, 183; 257/531

(56) References Cited

U.S. PATENT DOCUMENTS 4,999,597 3/1991 Gaynor .
5,445,922 8/1995 Maple .
5,757,243 5/1998 Mizuno et al. .
5,793,272 * 8/1998 Burghartz et al. ..... 336/200
5,805,043 9/1998 Bahl .
6,060,976 * 5/2000 Yamaguchi et al. ..... 336/200

OTHER PUBLICATIONS

International Search Report Date of Completion: Nov. 26, 1999; Date of Mailing: Dec. 1, 1999.

* cited by examiner

*Primary Examiner*—Lincoln Donovan
*Assistant Examiner*—Tuyen Nguyen
(74) *Attorney, Agent, or Firm*—Burns, Doane, Swecker & Mathis, L.L.P.

(57) ABSTRACT

A balanced inductor formed on lossy substrate material having adjacent strips leading current in opposite directions and being arranged in such a way that substrate currents relating to individual strips (1) induced in the lossy substrate (3) are balancing out one another leading to high Q-values. The inductor structure according to the invention can be implemented in MMIC devices using standard semiconductor substrates and do not require any special treatment of the substrate being needed.

14 Claims, 8 Drawing Sheets

| STRUCTURE | bL (μm) | bW (μm) | bs1 (μm) | bs2 (μm) | bs3 (μm) | COUPLING |
|---|---|---|---|---|---|---|
| O' | 290 | 290 | – | – | – | NO STRIP TERMINAL GROUNDED |
| B* | 290 | 290 | 90 | 90 | 90 | ONE TERMINAL GROUNDED |
| B° | 290 | 290 | 125 | 20 | 125 | NO STRIP TERMINAL GROUNDED |
| B | 290 | 290 | 90 | 90 | 90 | NO STRIP TERMINAL GROUNDED |
| C | 290 | 290 | 90 | 90 | 90 | NO STRIP TERMINAL GROUNDED |

FIG. 19

| | R (Ω) | | | L(pH) | | | Q | | |
|---|---|---|---|---|---|---|---|---|---|
| FREQ. (GHz) | 1.0 | 6.0 | 11.0 | 1.0 | 6.0 | 11.0 | 1.0 | 6.0 | 11.0 |
| O | 0,9 | 3,0 | 7,7 | 790 | 810 | 890 | 5,5 | 10,5 | 8,0 |
| B* | 0,4 | 1,4 | 2,9 | 295 | 300 | 315 | 6,0 | 9,5 | 9,0 |
| B° | 0,4 | 0,9 | 1,6 | 310 | 300 | 305 | 5,0 | 13 | 13 |
| B | 0,4 | 0,9 | 1,5 | 345 | 335 | 335 | 5,0 | 15 | 16 |
| C | 0,4 | 0,75 | 1,2 | 310 | 300 | 300 | 5,0 | 15 | 17 |

FIG. 20

BALANCED INDUCTOR

This application claims priority under 35 U.S.C. §§119 and/or 365 to 9901060-5 filed in Sweden on Mar. 23, 1999; the entire content of which is hereby incorporated by reference.

FIELD OF THE INVENTION

The present invention relates to an inductor formed directly on a low resistivity substrate, such as a thin film substrate or a semiconductor substrate. More specifically, the invention relates to a planar inductor formed on a low resistivity substrate, such as silicon, which is compliant for MMIC (Microwave Monolithic Integrated Circuit) production.

BACKGROUND OF THE INVENTION

Thin film inductors are widely used in integrated circuits. Usually planar inductors of rectangular, octagonal or circular layout are used, since these are easy to manufacture, having regard to the often very small dimensions required. Inductors are often provided in microwave monolithic integrated circuits, MMIC's. Certain requirements apply to inductors in MMIC's because of the semiconductor substrates used for fabricating such devices.

A particular problem is that losses occur for inductors, which are formed on low resistivity or lossy substrate materials.

Losses in the inductors can be overcome by using semiconductor substrates such as GaAs or other high resistivity substrates having a resistivity p>100 Ωm, but these substrate materials are relatively expensive.

Silicon on the other hand, which has many excellent properties including a relatively low price, is not an ideal substrate material for inductors because of its lossy properties ranging in the area of 0,0001–20 Ωm. The relatively low resistance of the material leads to eddy currents being generated in the substrate, which then again lead to losses occurring in the inductor.

The losses for a given inductor can be expressed by means of the so-called Q-factor, which in a simple case may be regarded as the ratio of the conserved magnetic energy to the losses. it can be represented as $$Q=(\omega L/r) \tag{I}$$

where L is the inductance of the coil, r is the resistance taking into account the losses and ω is the circular frequency. At microwave frequencies, the total losses are given by ohmic resistance to the currents flowing in the strips and the dielectric losses in the surrounding dielectrics, such as the substrate. The losses and the overall performance of the inductance depend not only on the geometry and materials involved but also on the way the inductors are coupled in the actual application. These effects shall be dealt with briefly in the following by reference to appropriate models for an inductor.

A planar inductor usually has two terminals relating to the conductive pattern provided on the face of the substrate and it may have a ground plane arranged on the opposite face, the ground plane being provided with one or more terminals.

FIG. 1 shows a known inductor having a simple loop structure being arranged on a dielectric or semiconductor substrate and having an optional ground plane being provided on the opposite side of the substrate. FIG. 2 is a cross-sectional view of the inductor shown on FIG. 1.

FIG. 3 relates to a known meander structure, which requires a ground plane for the return current. FIG. 4 is a cross-sectional view of the inductor shown on FIG. 3.

The terminals of the inductors can be coupled in various combinations. FIGS. 5, 6 and 7 depicts three main models corresponding to different ways of coupling the inductor and optionally arranging the ground plane for the plane inductors such as those shown in FIGS. 1–4.

In FIG. 5 the inductor has a ground plane and is coupled as a two port, that is, the input terminals are formed between the terminal strip and the ground plane and the output port is formed between the terminal relating to the other end of the strip and the terminal of the adjacent ground plane.

In the FIG. 5 configuration, return currents are flowing through the ground plane and a parasitic capacitance Cp and resistance Rp exist between the inductor strips and the ground plane. $r_{strip}$ represents the losses in the strips and the losses in the ground plane. Additional ohmic losses (free carrier absorption) appear if the substrate is made of a semiconductor with free-charge carriers. These free carriers cause substrate currents between points of the strips having a potential difference (cf. FIG. 2). The losses associated therewith are represented by the shunt loss resistance Rs. Cs is the parasitic capacitance due to the capacitive coupling between the strips and through the dielectric substrate. Finally, the losses relating to the parasitic currents, which are shown in FIG. 1*a* with dotted arrows being of opposite direction to the main strip currents, are represented by the losses in $r_{substr}$ in the model according to FIG. 5.

FIG. 6 shows a one-port configuration, whereby the inductor is provided with a ground plane on the backside of the substrate and whereby the output port has been shorted. The components correspond to those shown in FIG. 5 (In this coupling, return current is flowing in the ground?).

For the inductor shown in FIG. 7, no ground plane has been provided or none of the strip terminals have been grounded. In this case, there is no parasitic capacitance Cp and no parasitic resistance Rp.

It can be demonstrated that in many cases the inductor configurations shown on FIGS. 5–7 may be transformed to the more simplified circuit shown on FIG. 8.

It should be noted that using the simplified equivalent of FIG. 8 for the FIG. 7 arrangement, R equals Rs, C equals Cs and r equals $r_{substr}+r_{strip}$. Correspondingly, it can be shown that the parameters of the simplified equivalent of FIG. 8 can also be expressed by means of values calculated on the basis of the parameters given according to FIGS. 5 and 6.

According to prior art document "On-chip Spiral Inductors With Patterned Ground Shields for Si Based RFICs", by Yue et al, IEEE Journ. Solid State electronics, vol. 33, no5, pp.743, (year?)(D1) the Q-factor according to the above simplified embodiment may be given as:

$$Q=\frac{\omega L}{r}\cdot\frac{R}{R+r\left(1+\frac{\omega L}{r}\right)}\cdot\left(1-r^2\frac{C}{L}-\omega^2 LC\right) \tag{II}$$

In the above expression, R equals Rs, while r equals $r_{substr}+r_{strip}$.

Several proposals have been put forward in the past for reducing substrate currents in lossy substrates in order to increase the Q-value.

Many proposals are based on performing changes in the substrate so as to transform the resistances r and R. In document U.S. Pat. No. 5,757,243 (D2) an inductor has been shown, whereby low and high resistivity layers are formed in the substrate by diffusion or other relevant techniques in order to reduce the substrate currents.

Prior art document "Reducing the substrate losses of RF Integrated Inductors", Mernyei et al., IEEE Microwave and Guided Wave Letters, Vol. 8, No 9, pp. 300,1998 (D3), discloses a spiral planar inductor, which has been shown in FIGS. 9 and 10 of this patent application. The inductor according to the above document has a star shaped blocking structure, 2, embedded in the substrate, having layers denoted by reference numerals 4–7.

For the inductor according to prior art document D1 mentioned above, slots are provided in the low resistivity substrate under the inductor in order to reduce circumferential currents.

According to prior art document "Large suspended Inductors on Silicon and Their Use in a 2 μm CMOS RF amplifier", by J. Y. C. Chang, IEEE Electron Device Letters, Vol. 14, No. 5, pp. 246, May 1993 (D4) the silicon substrate underneath specific strips in the inductor structure has been removed by under-etching.

The above techniques, however, require additional masks and technological processes, are therefore costly to very costly, and are not practical for large-scale industrial application.

According to JP-A-06 224 042 (D5), a planar inductor has been disclosed comprising two magnetic wafers separated by a glass film, one wafer having slots in the shape of a meander, which enables the formation of a copper inductor being formed adjacent the glass film. The structure of the inductor according to this document has a set of input terminals being arranged close together. The inductor is claimed to provide enhanced high frequency characteristics and a high quality factor value. However, the wafers, which are made of nickel-zinc ferrite, have a high resistance factor. Moreover, the inductor does not appear suitable for the microwave range of above 300 Mhz and substantial losses in this range are expected. The inductor according to D5 requires a complex manufacturing technique, which is incompatible with MMIC manufacture.

In prior art document "A Q-factor enhancement technique for MMIC inductors", by M. Danesh et al., IEEE MTT-S Digest, 5/1998 (D6) a square spiral microstrip inductor fabricated in a production silicon IC technology has been disclosed.

According to document D6, it has been shown that driving the microstrip structure differentially yields a significantly higher Q-factor as compared to driving the structure "single ended", i.e. connecting the source to one terminal while connecting the other terminal to ground.

SUMMARY OF THE INVENTION

One object of the present invention is to set forth an inductor, which can be manufactured on a low resistivity substrate without any special preparation of the substrate being needed, the inductor providing a reduced level of induced currents in the substrate and hence higher Q-values.

This object has been achieved by the subject matter defined by independent claim 1, whereby conductive strips formed on a lossy substrate form at least one loop having one or more segments of pairwise adjacent parallel legs of substantially the same length being substantially aligned with one another and being arranged for carrying currents in opposite directions, such that currents induced in the lossy substrate relating to each respective leg in the segment balance one another.

It is another object to provide an inductor structure, for accomplishing further reductions in substrate currents and higher Q-values for a given area.

This object has been achieved by the subject matter defined by claim 2, whereby a bridge portion closes the at least one loop, such that a confined area is defined within the at least one loop and the bridge portion as seen from above.

It is another object to provide a space efficient inductor structure. This object has been accomplished especially by the subject matter defined by claim 3.

Further advantageous solutions are defined in the dependent claims, which provide for advantageous combinations of Q-values, inductance values and resistance values.

Among the further important advantages of the invention is that an inductor of high mechanical stability has been provided.

DETAILED DESCRIPTION OF THE PREFERRED EMBODIMENTS OF THE INVENTION

For better understanding the invention we shall discuss the general definition of the Q-factor as set out above, namely as the ratio of the stored average energy to the average loss per time unit, the ratio being multiplied with the circular frequency.

Figure 8:
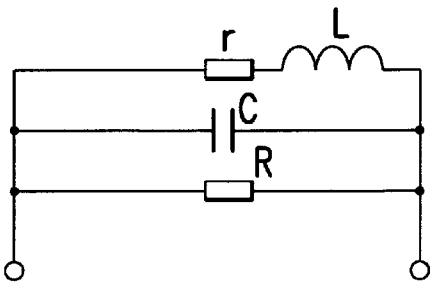
FIG.8 PRIOR ART
Figure 9:
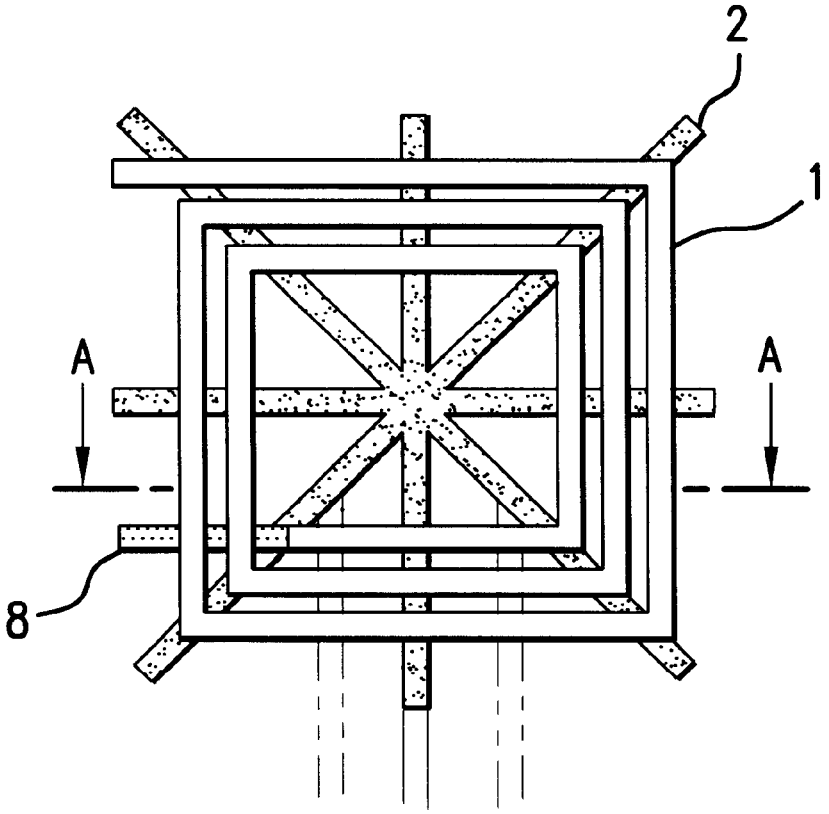
FIG.9 PRIOR ART
Figure 10:
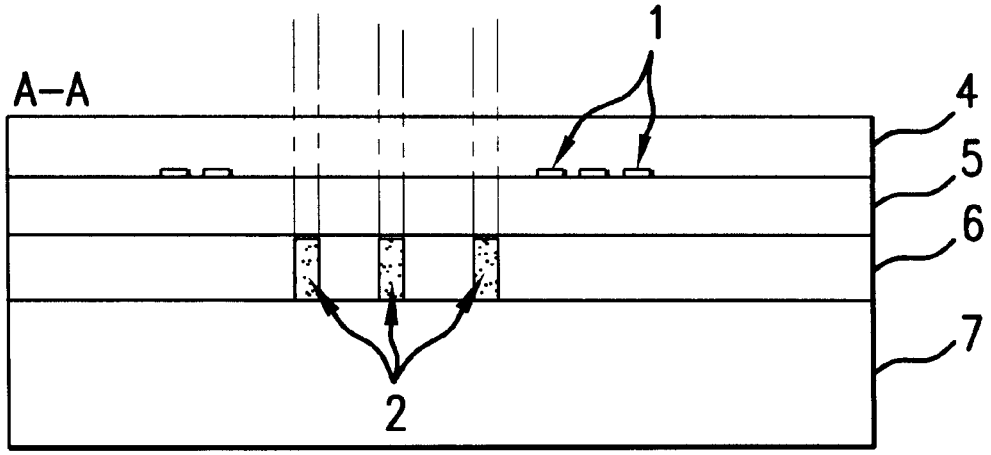
FIG.10 PRIOR ART

The stored energy is given by the inductances and capacitances and may be represented as a sum of self-inductances and mutual inductances of the strips. As a first approximation, ignoring the energy stored in the capacitance, the stored energy in the inductance is proportional to $\Sigma(L_i+M_{ij})$, where $L_i$ is the self inductance of the i-th strip and $M_{ij}$ is the mutual inductance between strips i and j. For contra-directional currents, the mutual inductance is negative. The losses may be given by the resistances shown in the equivalent circuit of FIG. 8. In particular, the losses due to the substrate currents can be expressed as: $P_{substr}=G_1 \cdot i_{substr}^2 \cdot r_{substr}$, where $G_1$ is a geometric factor given by the geometry of the strips and the current distribution in the substrate. Similarly, the losses in the strips are: $P_{str}=G_2 \cdot i_{str}^2 \cdot r_{str}$. The reduced current density in the semiconductor substrate and in the ground plane if available, results in lower microwave losses and higher Q-factor values being achieved for the inductor.

According to the present invention the substrate currents and hence the losses of the inductor are reduced by arranging the strips in such a way that the currents induced in the substrate balance one another.

Figure 12:
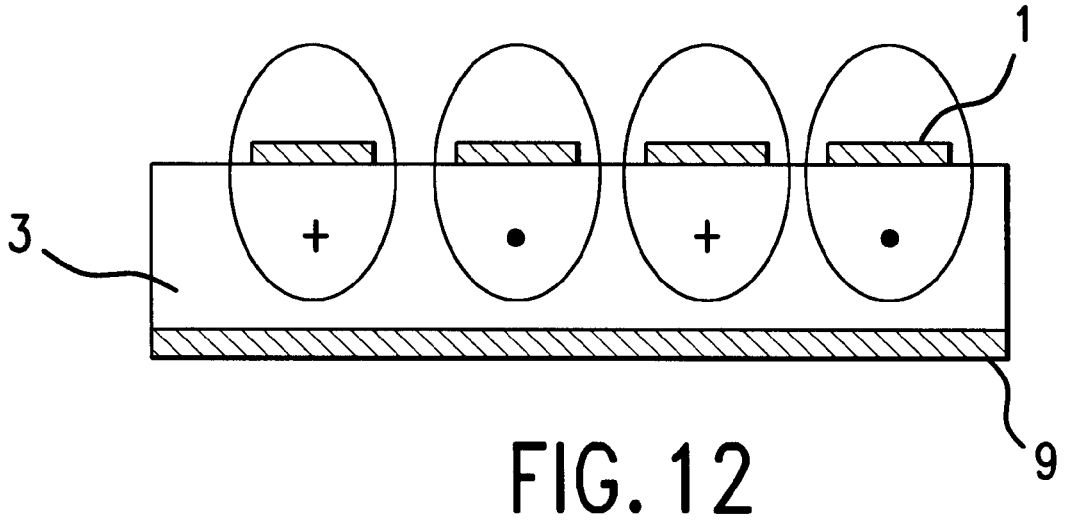

FIG. 12 is a cross sectional schematic representation of an inductor structure relating to a preferred group of inductors according to the invention, whereby the direction of the currents induced in the substrate has been indicated (+ into/· out of the plane of the paper). It is seen that the currents in adjacent strips are of opposite direction.

Figure 11:
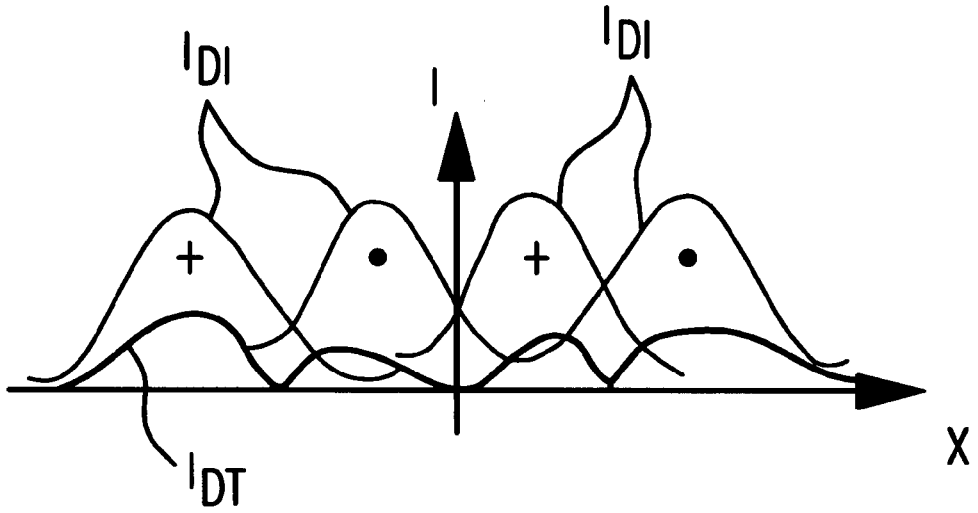
FIGS. 11 and 12 is a schematic illustration of the balancing of substrate currents according to the invention.

In FIG. 11, the current density in the substrate according to the lateral location has been shown for a given depth. The X-axis in FIG. 11 correspond to the surface extension of the substrate shown in FIG. 12 and the individual graphs $I_{D1}$ in FIG. 11 pertains to the substrate current density, which would occur for a given current magnitude, had the other strips not carried any current. The resultant current density $I_{DT}$ relating to all the strips carrying the same given current magnitude has also been indicated.

Figure 1:
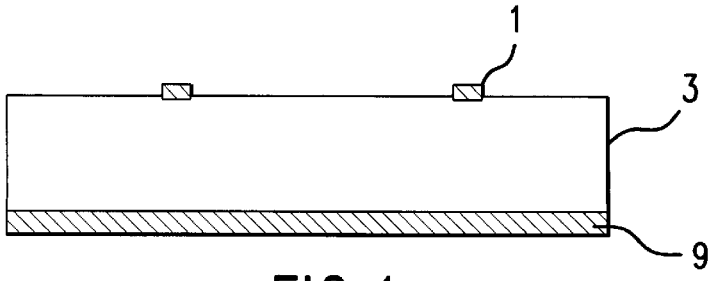
FIG. 1 is a side view first known simple loop inductor (O)
Figure 2:
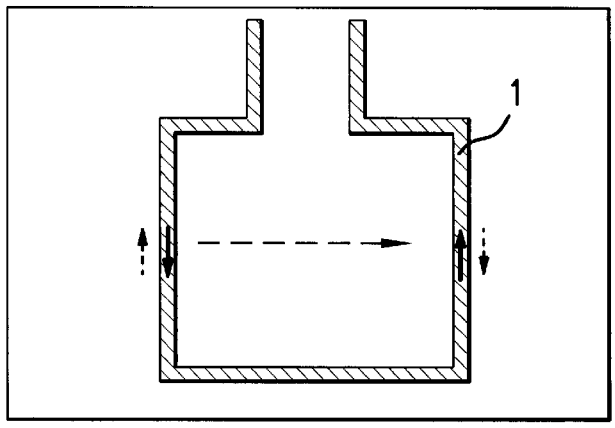
FIG.2 PRIOR ART
FIG. 2 is an upper view of the first known loop inductor (O)
Figure 3:
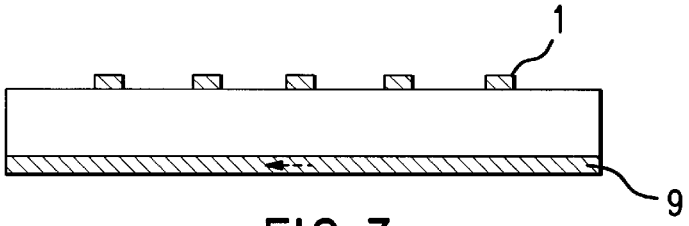
FIGS. 3 and 4 shows a second known meander inductor.
Figure 4:
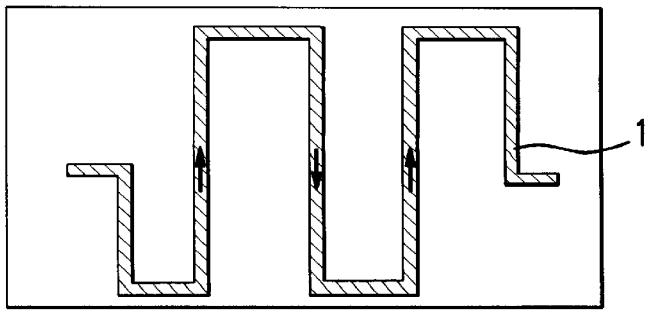
Figure 5:
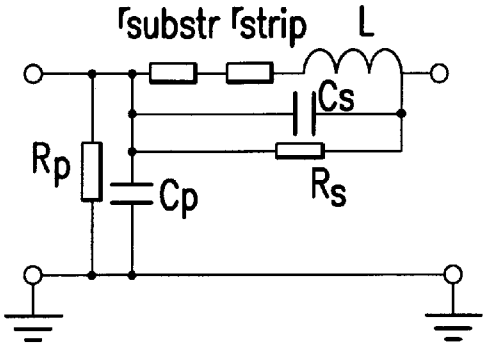
FIG.5 PRIOR ART
FIGS. 5–8 disclose known equivalent circuits for inductors in various coupling schemes, FIGS. 9 and 10 relates to a third structure known according to JP-A-06 224 042 (D5)
Figure 7:
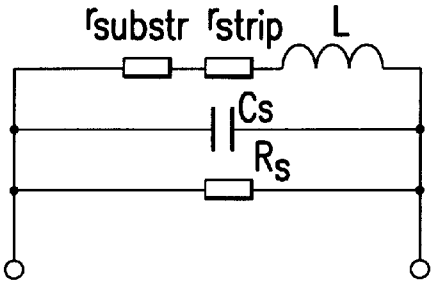
FIG.7 PRIOR ART
Figure 6:
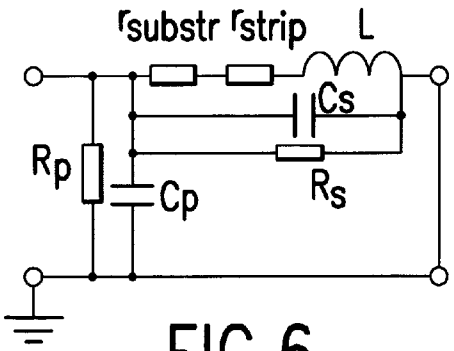
FIG.6 PRIOR ART

From FIG. 11 it appears that, the resultant current density is much lower than the current densities relating to the situation where strips are carrying the same current one at a time. This effect takes place because the currents in the substrate generate contra-directional magnetic fields around themselves. The magnetic fields in their turn induce contra-directional currents in the semiconductor substrate as shown in FIG. 2. Since these currents are also contra-directional to one another, they partly balance out one another and the resultant substrate current is smaller than the individual substrate currents.

The most effective reduction of the resultant currents is achieved where the strips have identical cross-section, i.e. have the same width w and where the distance $b_s$ between them is sufficiently small to optimise the Q value, i.e. where values of first and foremost $r_{substr}$, $r_{strip}$, and L but also Rp, Cs, Cp are optimised.

If the distance between the strips is chosen too small, the inductance L will suffer and the effective resistance $r_{substr}$ will become to small leading to currents leaking between the strips. On the other hand, if the distance is chosen too high the distance between the induced adjacent magnetic fields will not affect one another, and thus not lead to a reduction of currents in the substrate.

To optimise the design of the coil for a given set of parameters such as frequency of interest, substrate thickness, substrate resistivity, strip conductivity and strip cross-section, one needs to change the strip separation, experimentally or numerically, until the currents in the lossy substrate balance one another and the maximum Q-factor is achieved.

Practical experiments show that the balancing of currents in the substrate is dominant for substrates having a resistivity of up to approximately 10 Ω·m In FIGS. 13–16 preferred inductor structures A–D of the invention have been shown. The structures form examples of particular advantageous designs of inductors providing near optimum separation of strips. Structures A–C correspond to the cross-section shown in FIG. 11 and facilitate achieving especially high Q-values.

Particular high Q-values are moreover found where the terminals of the inductor are arranged close together in relation to the wavelength intended for the inductor, i.e. where the distance between the terminals satisfies the following condition: $bt \leqq \lambda/(10\sqrt{\epsilon_{ef}})$, where $\epsilon_{ef}$ is the effective dielectric constant of the substrate and λ is the wavelength corresponding to the operational frequency of the inductor. Moreover, good results are achieved where the inductor structure is coupled differentially, i.e. in a coupling where none of the input terminals are connected to the ground plane.

The strips, 1, according to the above structures A–D are forming at least a first loop, 13, having one or more segments of pair-wise disposed adjacent parallel legs of substantially the same length, being substantially aligned with one another. It is seen that structures A, C and D have completely aligned legs, while the legs of structure B are substantially aligned.

Moreover, the adjacent strips are being arranged for carrying currents in opposite directions, such that currents induced in the lossy substrate from each respective leg in the segment balance each other.

It is noted that the strips of the inductor structures are being arranged such that no two adjacent strips are carrying current in the same direction.

Figure 13:
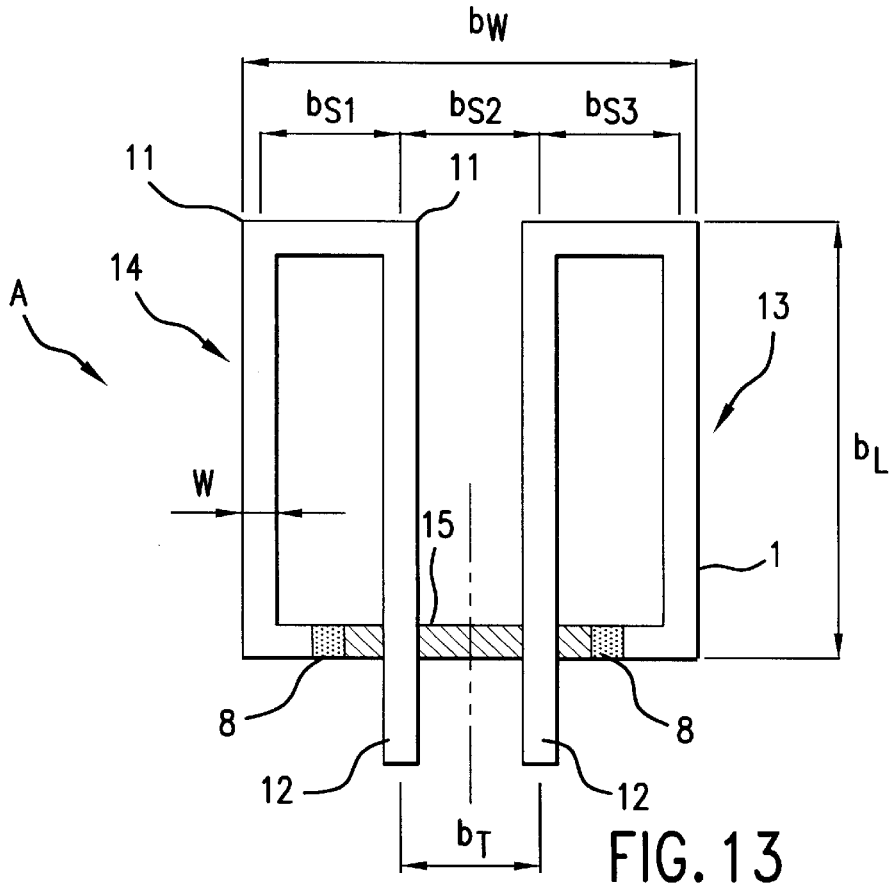
FIG. 13 shows a first inductor structure (A) according to the invention.

The structure A according to FIG. 13, comprises four parallel strips 1 and other strips being orthogonal to and connected with the former through corner portions 11, the strips forming two loops 13 and 14 being symmetrical and connected with one another through bridge portion 15. The strips 1 have a uniform width. Two terminals 12 are formed as a prolongation of the two inner strips of the four parallel strips. The loops are elongate and square shaped. The confined area defined by each loop 13 or 14 and the bridge portion 15 has an aspect ratio $b_L/b_s$ of about 3. According to the preferred embodiments in FIGS. 13 and 14 $b_s=b_{s1}=b_{s2}=b_{s3}$ The bridge portion 15, comprises vias 8 which connect the strip of the bridge portion with the strips of the respective loops. The bridge portion crosses the over- or underlying strip at a right angle.

Figure 14:
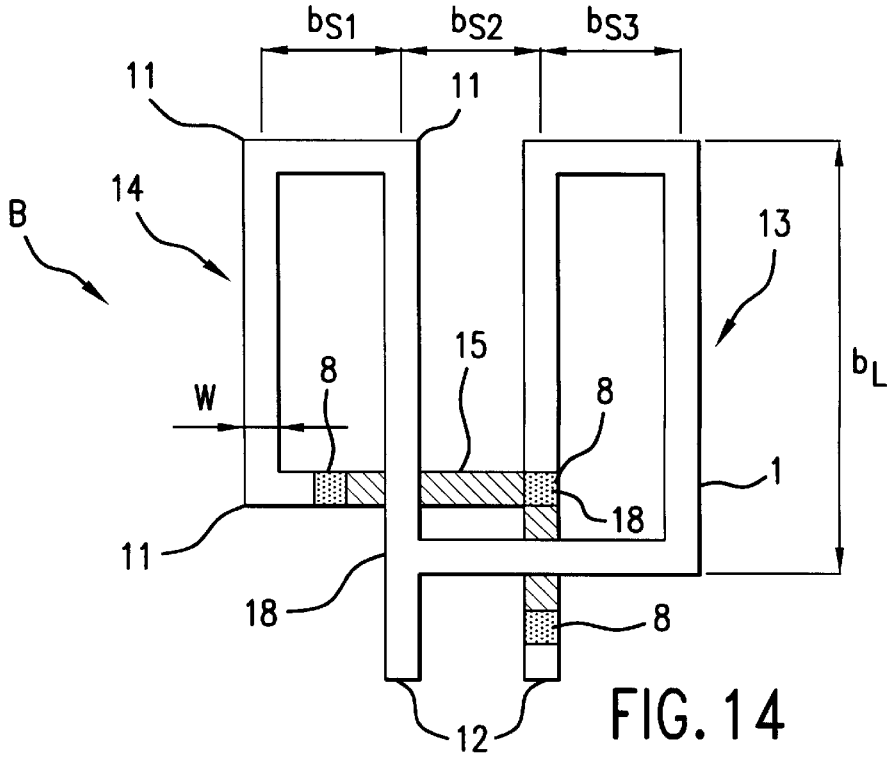
FIG. 14 shows a second inductor structure (B) according to the invention.
Figure 15:
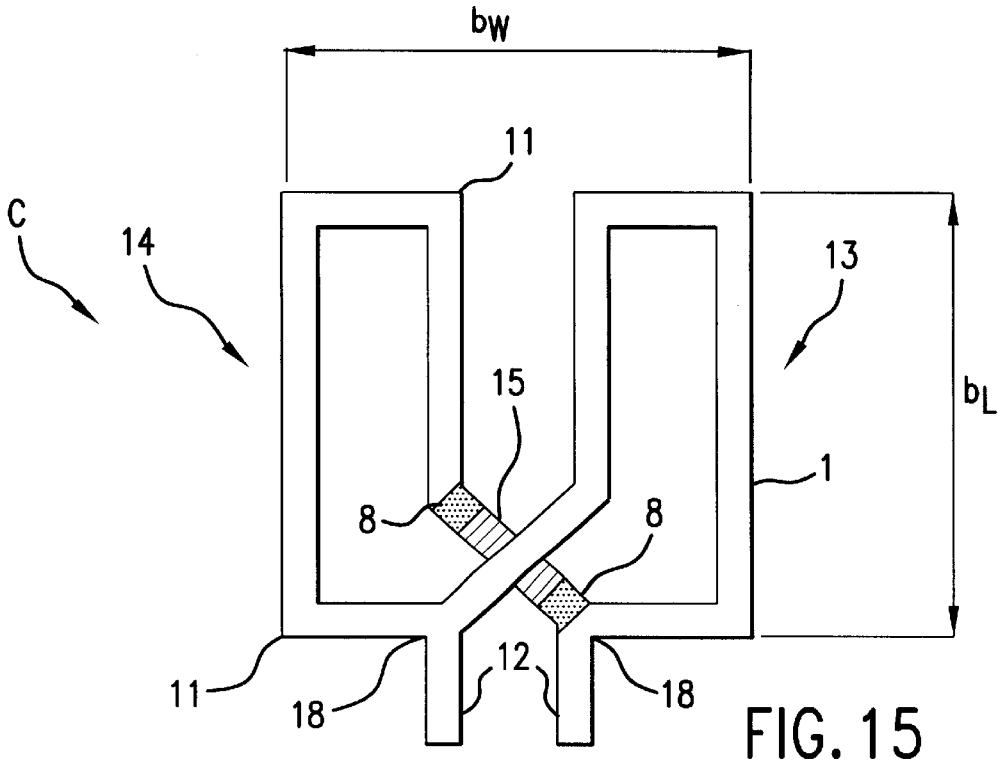
FIG. 15 shows a third inductor structure (C) according to the invention.
Figure 16:
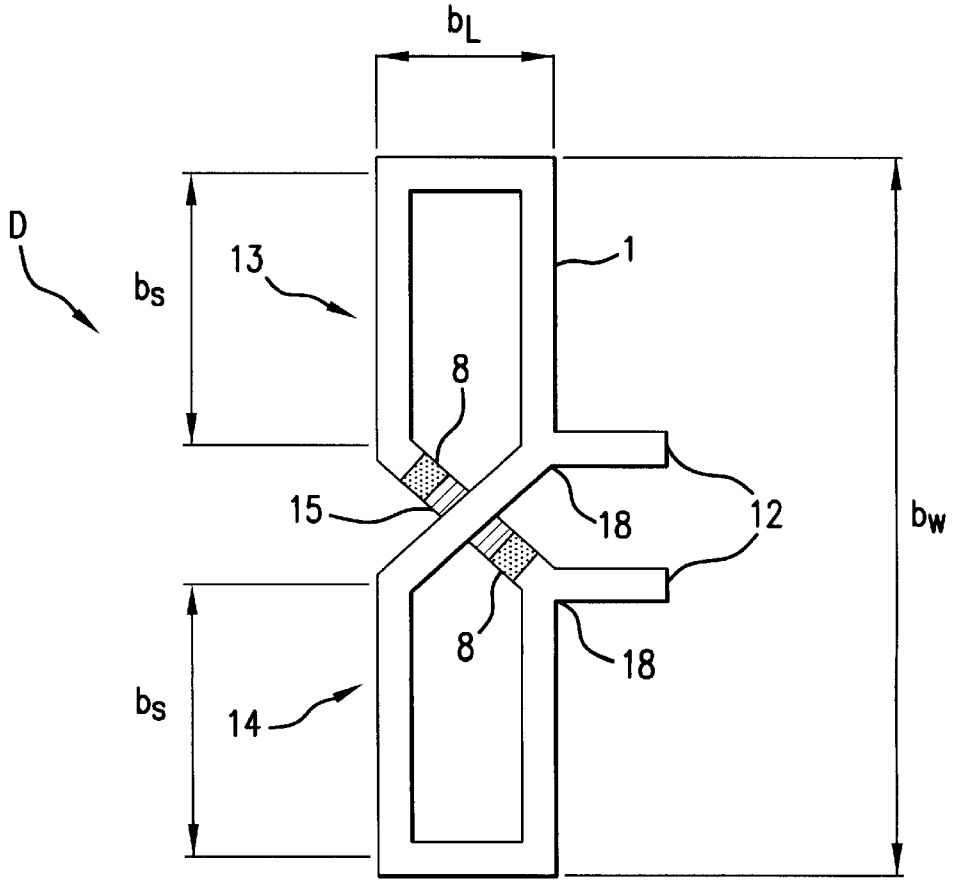
FIG. 16 shows a fourth inductor structure (D) according to the invention.

Structure B shown in FIG. 14 also comprises two loops comprising four parallel strips of substantially the same length, but in this structure two nodes 18 are arranged in the vicinity of the terminals 12, whereby the current branches to the two respective loops, 13 and 14 in one of the nodes, 18, and returns by means of the other node, 18.

Structure C constitutes a modification over structure B, in that the bridge portion has been arranged so as to only cross one strip.

Structure D constitutes a modification over structure C, in that the aspect ratio $b_L/b_s$ of the loops has been altered from a value of about 3 to a value of about 1/3.

For the structures A–D shown, the comer portions 11, between orthogonally disposed strips form right angles, but it should be understood that the right angle corner portion could be substituted by a rounded corner portion (not shown) having a certain rounding radius $r_a$ measured from the centre of the strip, satisfying the condition: $w \leqq r_a \leqq b_L/10$ and for FIG. 16: $w \leqq r_a \leqq b_w/20$. Moreover, the corner portions may also be chamfered as known in the art.

As will be understood from the structures according to the above figures, the balancing depends on the aspect ratio defined by the length of the segments having parallel adjacent legs, $b_L$ to the separation distance or segment width, $b_s$. The balancing is smallest where for instance in FIGS. 13 and 14 the aspect ratio is $b_L/b_s=1$ or $b_w/b_s=$. Tests show that good values are found where the aspect ratio of the loop is more than 2 to 1 or less than 1 to 2. Even better results are obtained when the aspect ratio is more than 3 to 1 or less than 1 to 3.

The high Q values are also believed to arise from the symmetry of the above structures and the central arrangement of the terminals in relation to the overall inductor structure.

It is noted that the adjacent legs corresponding to the legs of each respective loop, in each of the structures mentioned above, carries current in opposite directions whereby, currents are also balanced between these strips, c.f. FIGS. 11 and 12.

Figure 17:
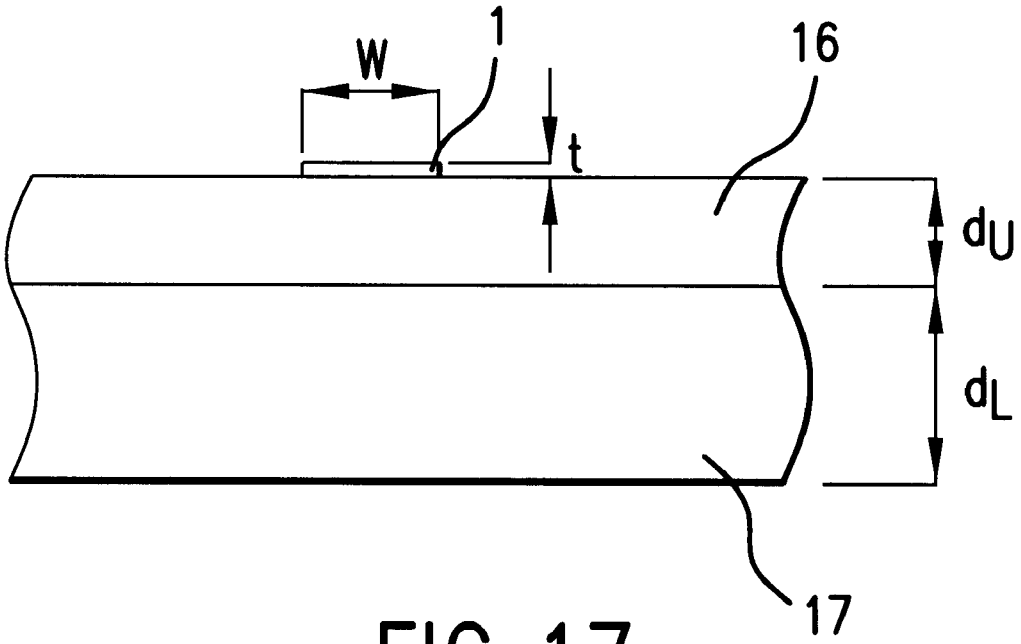
FIG. 17 shows one possible implementation of the substrate and the strip configuration according to the invention.

Moreover, good results are gained, where the distance between adjacent legs is within the interval of 2W to 10 W, where W denotes the width of the strip. In FIG. 17, the cross-section of a possible substrate/strip configuration for the inductor structures according to the invention has been disclosed. In this exemplary embodiment, the strips are made of gold and has a thickness, t, of 1 $\mu$m. The width of the strip is 20 $\mu$m. The substrate contains an upper silicon layer, 16, of 45 $\mu$m thickness, $d_u$, having a conductivity of 2,5 $(\Omega m)^{-1}$ and a lower silicon layer, 17, of 360 $\mu$m, $d_L$, having a conductivity of $10^4$ $(\Omega m)^{-1}$.

It should be noted that the invention would not only be restricted to the substrate/strip configuration defined above. The invention would also be applicable to a single layer semiconductor sheet or a substrate having several epitaxial layers. In addition, dielectric films could be provided to the extent that substrate currents would occur in a lossy part of the substrate. As long as currents can potentially be induced in a lossy substrate, the balancing of currents in the lossy part of the substrate can be effected according to the principles described above.

Figure 18:
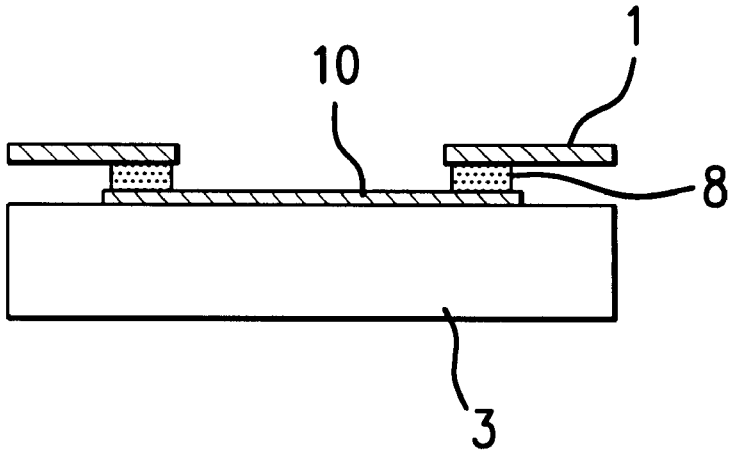
FIG. 18 shows via used in the inductor structures according to the invention (Is the drawing complete?), FIG. 19 refers to a table stating the dimensions for a modified simple loop structure (O') and the second (B) and the third (C) structure according to the invention in various coupling schemes, and FIG. 20 refers to simulation values of the inductor structures defined by the table according to FIG. 19 using the substrate/strip configuration shown in FIG. 17.

In FIG. 18, a possible implementation of the bridge portion according to the invention has been shown. The bridge portion, 15, is in this example carried out as an underpass strip 10, which are connecting to the higher layer strips, 1, through vias, 8. Alternatively, the bridge portion may be formed as an air bridge. Advantageously, the height of the via should be equal or smaller than the width of the strips. The via can be made of the same material as the strips, e.g. gold.

FIG. 20 relates to a table of simulated test results for the structures B, C of the invention and modified reference structure O' of the prior art structure O mentioned above, whereby structure B were coupled in various ways and had various aspect ratios. The structures under simulation had the cross-sectional dimensions and constitution shown in FIG. 17.

The dimensions of the structures and the applicable manner of coupling (see O', B, B° and C), have been specified in the table according to FIG. 19. The simulation tool used was Momentum ® in Hewlett Packard's ® Microwave Device Simulator (MDS). All tests were performed on microstrip structures having a strip width of 20 $\mu$m. The distance between the terminals was 90 $\mu$m. Reference inductor structure O' (not shown) generally had the outline as structure O shown in FIG. 2. The outer dimensions for structure O' were 290 $\mu$m times 290 $\mu$m and the distance between the terminals was 90 $\mu$m. One of the terminals extended from one of the side strips of the terminal, hence the terminals of structure O' were not centred as shown structure O in FIG. 2.

As appears from the simulation results specified in the table in FIG. 20, the structures according to the invention have higher Q-factors as compared to the known design. It is found that, especially at high microwave frequencies, i.e. above 6 Ghz, the structures according to the invention provide significant increases in Q-values.

The inductor structures according to the invention may therefore readily be applied in a wide range of MMIC applications such as balanced amplifiers, mixers, and voltage controlled oscillators and hence redefine the performance of such applications.

List of Reference Signs

1 strip
2 blocking structure
3 substrate
4 first layer
5 second layer
6 third layer
7 fourth layer
8 via
9 ground plane
10 underpass strip
11 comer portion
12 strip terminal
13 first loop
14 secondloop
15 bridge portion
16 upper layer
17 lower layer
18 node

What is claimed is:

1. An inductor comprising:

a lossy substrate;

conductive strips disposed on said lossy substrate;

at least two terminals connected to the conductive strips wherein a distance between the terminals is less than a wavelength corresponding to the operational frequency of the inductor;

wherein the conductive strips are positioned to form a first loop and are arranged for carrying currents in opposite directions and further arranged so that no two adjacent strips carry current in the same direction, thereby enabling currents induced in the lossy substrate to balance each other;

wherein said distance is less than $\lambda/(10\sqrt{E_{\omega}})$, where E is an effective dielectric constant of the substrate and $\lambda$ is the wavelength intended for the inductor.

2. The inductor according to claim 1, comprising a bridge portion.

3. The inductor according to claim 2, wherein the first loop has an elongate substantially rectangular shape and wherein the aspect ratio of the first loop, defined as the length, $b_L$, to the width, $b_S$, of the area formed by the first loop more than 2 to 1 or less than 1 to 2.

4. The inductor according to claim 3, wherein the aspect ratio is more than 3 to 1 or less than 1 to 3.

5. The inductor according to claim 2, comprising at least a second loop being symmetrical to the first loop and connected with the first loop by way of the bridge portion.

6. The inductor according to the claim 2, wherein the two terminals connected to the strips are being provided near the bridge portion.

7. The inductor according to claim 3, wherein the width $b_S$, between adjacent strips is within the interval 2 W to 10 W, where W denotes the width of the strips.

8. The inductor according to claim 1, wherein the substrate comprises a ground plane.

9. The inductor according to claim 1, constructed for use in the frequency range of above 300 MHZ.

10. The inductor according to claim 1, having corner portions with rounded or chamfered corners.

11. The inductor according to claim 5, further comprising two nodes (18), wherein the current branches to the respective first and second loops, (13, 14) in one of the nodes (18) and returns by means of the other node (18).

12. The inductor according to claim 2, further comprising a second loop having one or more segments of adjacent parallel legs being aligned and connected with one another and being arranged for carrying currents in opposite directions and connected to the first loop by way of the bridge portion.

13. The inductor according to claim 1, wherein the substrate has a resistivity of less than 10 Ω·m.

14. The inductor according to claim 1, wherein the conductive strips, which form the first loop, are made up of one or more segments of adjacent parallel legs.

* * * * *

UNITED STATES PATENT AND TRADEMARK OFFICE

CERTIFICATE OF CORRECTION

PATENT NO. : 6,320,491 B1 
DATED : November 20, 2001
INVENTOR(S) : Spartak Gevorgian et al.

It is certified that error appears in the above-identified patent and that said Letters Patent is hereby corrected as shown below:

Column 2,
Line 32, delete "(In" and insert therefor -- In --.
Line 33, delete "?)" and insert therefor -- . --.
Line 49, delete "(year?)" and insert therefor -- May 1998 --.

Column 4,
Line 38, delete "(Is the drawing complete?)".

Signed and Sealed this

Thirty-first Day of December, 2002

JAMES E. ROGAN
*Director of the United States Patent and Trademark Office*